US005568045A

United States Patent [19]

Koazechi

[11] Patent Number: 5,568,045

[45] Date of Patent: Oct. 22, 1996

[54] REFERENCE VOLTAGE GENERATOR OF A BAND-GAP REGULATOR TYPE USED IN CMOS TRANSISTOR CIRCUIT

[75] Inventor: Shin-ichi Koazechi, Tokyo, Japan

[73] Assignee: NEC Corporation, Tokyo, Japan

[21] Appl. No.: 164,149

[22] Filed: Dec. 9, 1993

[30] Foreign Application Priority Data

Dec. 9, 1992 [JP] Japan ..... 4-351931

[51] Int. Cl.[6] ..... G05F 3/16

[52] U.S. Cl. ..... 323/314; 323/316

[58] Field of Search ..... 323/313, 314, 323/315, 316

[56] References Cited

U.S. PATENT DOCUMENTS

| | | | |
|---|---|---|---|
| 4,458,200 | 7/1984 | Geller | 323/316 |
| 4,924,113 | 5/1990 | Schade | 323/316 |
| 4,931,718 | 6/1990 | Zitta | 323/313 |
| 4,978,868 | 12/1990 | Giordano et al. | 323/316 |
| 5,144,223 | 9/1992 | Gillingham | 323/313 |
| 5,153,500 | 10/1992 | Yamamoto et al. | 323/314 |
| 5,432,432 | 7/1995 | Kimura | 323/313 |

FOREIGN PATENT DOCUMENTS

| | | | |
|---|---|---|---|
| 0352044 | 1/1990 | European Pat. Off. | G05F 3/30 |
| 0472128 | 2/1992 | European Pat. Off. | G05F 3/28 |

OTHER PUBLICATIONS

"Operational Amplifiers and Voltage Regulators", IEEE International Solid–State Circuits Conference, vol. 28, Coral Gables, Florida, USA, Wrathall, Feb. 1985, pp. 144–145.

*Primary Examiner*—Jeffrey L. Sterrett

[57] ABSTRACT

A reference voltage generator of the so-called band-gap regulator type is disclosed, which includes a pair of bipolar transistors, a resistor circuit coupled to the bipolar transistors to make them operative in different current densities from each other to thereby produce a voltage relative to a difference in base-emitter voltage between the transistors, and an operational amplifier coupled to receive the voltage to control a current flowing through the resistor circuit, and further includes a level shifter inserted between the resistor circuit and the operational amplifier to receive and shift the voltage from the resistor circuit, the level shifter thereby shifting the voltage to produce a level-shifted voltage and the operational amplifier receiving the level-shifted voltage.

6 Claims, 2 Drawing Sheets

REFERENCE VOLTAGE GENERATOR OF A BAND-GAP REGULATOR TYPE USED IN CMOS TRANSISTOR CIRCUIT

BACKGROUND OF THE INVENTION

The present invention relates to a reference voltage generator and, more particularly, to such a generator of a band-gap regulator type used in a CMOS transistor circuit.

Although various types of reference voltage generators are employed in a transistor circuit to generate a reference voltage, the so-called band-gap regulator is advantageous in generating a reference voltage having characteristics stabled against change in temperature and in power supply voltage. The band-gap regulator requires a pair of bipolar transistors operating in different current densities from each other. The band-gap regulator used in a CMOS transistor circuit also has a pair of bipolar transistors, accordingly.

Referring to FIG. 1, the band-gap regulator 100 as a reference voltage generator used in the CMOS transistor circuit has a pair of bipolar transistors 4 and 5 and an operational amplifier 14 constituted of CMOS transistors. The collectors of the transistors 4 and 5 are connected to a power supply line 18. The emitter of the transistor 4 is connected through a resistor 1 to a ground line and further to the inverting input terminal 6 of the amplifier 14. The emitter of the transistor 5 is connected through resistors 2 and 3 to the ground line. The node of the resistors 2 and 3 is connected to the non-inverting terminal 7 of the amplifier 14 which has an output terminal lead as a reference voltage output terminal 15. The terminal 15 is connected through resistors 16 and 17 to the ground line, and the node of the resistors 16 and 17 is connected to the bases of the transistors 4 and 5.

Since the emitter of the transistor 4 is connected to the ground line through one resistor and the emitter of the transistor 5 is done through two resistors, the vase-emitter voltages of the transistors 4 and 5 are different from each other. That is, the transistors 4 and 5 operate in the different current densities. The difference in base-emitter voltage DVBE between the transistors 4 and 5 is therefore represented by the following equation (1):

$$\begin{aligned} DVBE &= VBE4 - VBE5 \\ &= (kT/q)\ln(n \cdot R3/R1) \end{aligned} \quad (1)$$

wherein VBE4 and VBE5 are the base-emitter voltages of the transistors 4 and 5, R1 and R3 are the resistance values of the resistors and n is the ratio in emitter are of the transistor 5 to the transistor 4. Further, k represents Boltzmann constant, T does absolute temperature and q does electron charge.

The current I5 indicative of the following equation (2) thus flows through the transistor 5:

$$\begin{aligned} I5 &= DVBE/R2 \\ &= (1/R2) \cdot (kT/q)\ln(n \cdot R3/R1) \end{aligned} \quad (2)$$

wherein R2 is the resistance value of the resistor 2. Assuming that the current I4 flows through the transistor 4, the voltage Va at the node 6 is represented as follows:

$$\begin{aligned} Va &= I4R1 = I5R3 \\ &= (R3/R2) \cdot (kT/q)\ln(n \cdot R3/R1) \end{aligned} \quad (3)$$

On the other hand, the base voltage Vb of the transistors 4 and 5 are as follows:

$$Vb=Va+VBE4=\{R17/(R16+R17\}\cdot Vo$$

wherein R16 and R17 are the resistance values of the resistors 16 and 17 and Vo is a reference voltage at the output terminal 15. From the equations (3) and (4), the reference voltage Vo is derived as follows:

$$Vo=\{(R16+R17)/R17\}\times\{VBE4+(R3/R2)\cdot(kT/q)ln(n\cdot R3/R1)\} \quad (4)$$

Thus, the output voltage Vo is dependent on the ratio in resistance value of between the resistors 16 and 17 and the voltage Va at the node 6 indicative of the equation (3). The voltage Va is in turn dependent on the ratio of the resistors R3 to R2, the emitter area ratio n, and the ratio of the resistors R3 to R1.

The ratio of the resistors R3 to R2 is, however, cannot be made large because the input offset voltage of the amplifier 14 is multiplied by that ratio. The emitter ration n is required to made small in order to reduce the area occupied by the transistors 4 and 5. The ratio of the resistors R3 to R1 is also required to made small because the voltage drop across the resistor R3 is to be small for the purpose of attaining the transistor operation for the transistors 4 and 5. As a result, the voltage Va becomes low inevitably. For example, such designs are made that R1=1 kΩ, R2=14 kΩ, R3=65 KΩ, and n=10, the voltage Va takes a value of 0.05 V.

Such a low voltage Va causes the MOS transistors in the operational amplifier 14 operate in a non-saturated region. Consequently, the output voltage of the amplifier 14, i.e. the reference voltage Vo, is easy to subjected to the noise voltage of the power supply voltage. In other words, the reference voltage Vo is varied in accordance with the noise components of the power supply voltage.

SUMMARY OF THE INVENTION

It is, therefore, an object of the present invention to provide an improved reference voltage generator of the band-gap regulator type.

It is another object of the present invention to provide a reference voltage generator of the band-gap regulator used in a CMOS transistor circuit, which generates a reference voltage stabled against the variation of a power supply voltage due to a noise component.

A reference voltage generator according to the present invention comprises a pair of bipolar transistors, a resistor circuit coupled to the pair of bipolar transistors in such a manner that the transistors operate in different current densities to thereby produce across a resistor a voltage relative to a difference in base-emitter voltage between the transistors, an operational amplifier composed of MOS transistors and coupled to the resistor circuit to receive the voltage across the resistor, and a level shift circuit inserted between the resistor circuit and the operational amplifier to shift the voltage across the resistor and supply the sifted-voltage to the operational amplifier.

With such a circuit construction as described above, the voltage across the resistor is shifted by the level shifter to such a value that cause MOS transistors in the operational amplifier to operate in a saturated region. Thus, reference voltage thus generated is stabilized against the variation of the power voltage.

BRIEF DESCRIPTION OF THE DRAWINGS

The above and other objects, advantages and features of the present invention will be more apparent from the following description taken in conjunction with the accompanying drawings, in which.

DETAILED DESCRIPTION OF THE PREFERRED EMBODIMENTS

Figure 1:
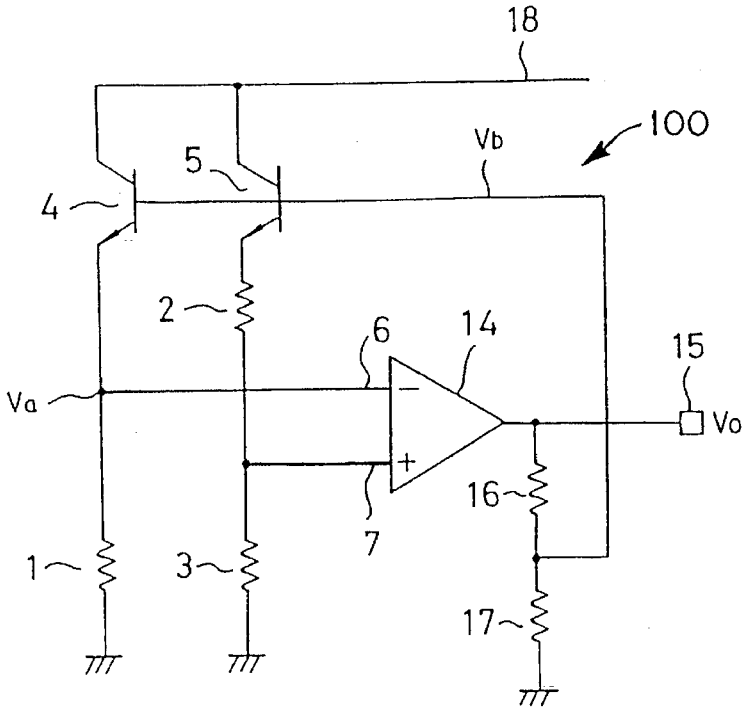
PRIOR ART FIG. 1
FIG. 1 is a circuit diagram illustrative of a reference voltage generator according to the prior art.
Figure 2:
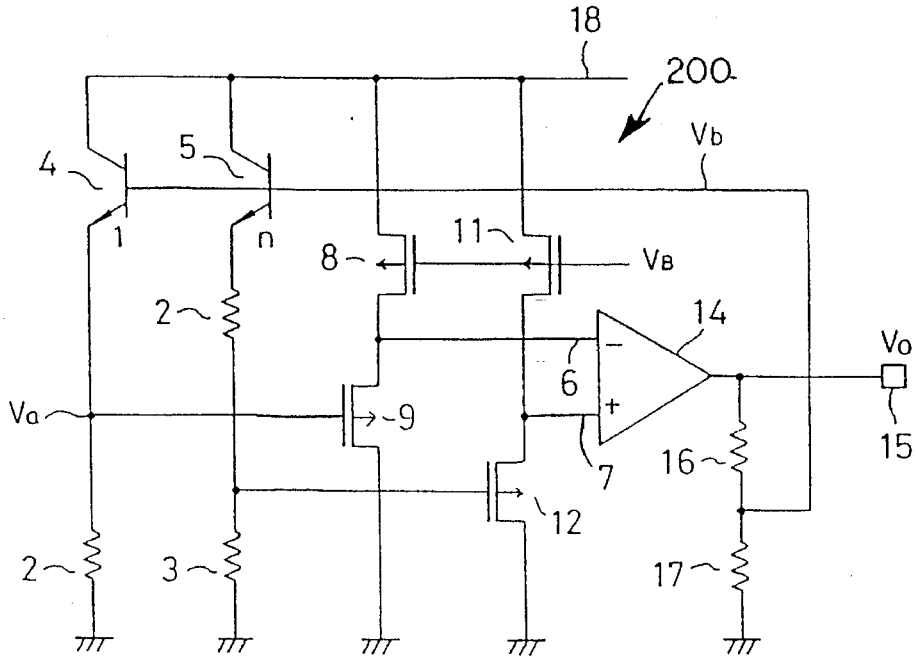
FIG. 2 is a circuit diagram illustrative of a reference voltage generator according to an embodiment of the present invention.

Referring now to FIG. 2, there is shown a reference voltage generator 200 according to an embodiment of the present invention in which the same constituents as those shown in FIG. 1 are denoted by the same reference numerals to omit the further description thereof. According to the present embodiment, a level shift circuit is further provide. This level shifter circuit includes four P-channel insulated gate field effect or MOS transistors 8–12. The transistors 8 and 9 are connected in series between the power supply line 18 and the ground line, and the transistors 11 and 12 are also connected in series between the power supply line 18 and the ground line. The gates of the transistors 8 and 11 are supplied with a bias voltage Vbias, and the gates of the transistors 9 and 12 are connected to the emitter of the transistor 4 and the node of the resistors 2 and 3, respectively. The node of the transistors 8 and 9 and that of the transistors 11 and 12 are connected to the inverting input terminal 6 and the non-inverting input node 7 of the operational amplifier 14, respectively.

Figure 4:
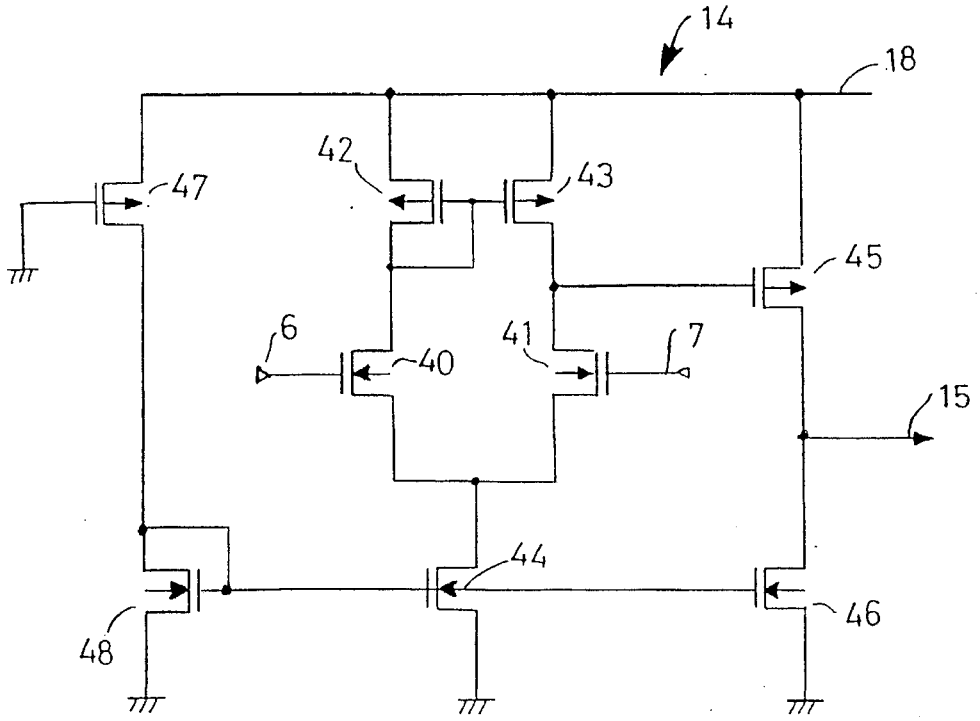
FIG. 4 is a circuit diagram representative of an operational amplifier shown in each of FIGS. 2 and 3.

Turning to FIG. 4, the operational amplifier 14 includes five N-channel MOS transistors 40, 41, 44, 46 and 48 and four P-channel MOS transistors 42, 43, 45 and 47 which are connected as shown. In particular, the transistors 40 and 41 constitutes an input differential stage, and the transistor 42 and 43 constitutes a current mirror circuit serving as an active load of the input differential stage. The transistors 45 and 46 constitutes an output stage, and the transistors 44, 47 and 48 serve as a current source, respectively.

Turning back to FIG. 2, the output voltage of the amplifier 14, i.e. the reference voltage Vo, is represented by the equation (5) as apparent form the comparison in circuit construction between FIGS. 1 and 2. However, each of the transistors 9 and 12 level-shifts the voltage Va by a predetermined level toward the power supply voltage, and the operational amplifier 14 receives the voltage thus level-shifted. The level subject to the level-shift is determined by the size of each of the transistors 8–12 and the bias voltage Vbias. For example, assuming that each of the transistors 8–12 has a gate width of 5 μ and a gate length of 10 μ and the bias voltage Vbias is 3.5 V, the voltage Va is shifted from 0.05 V to 2.0 V. Therefore, each of the transistors 40 and 41 (FIG. 4) in the operational amplifier operates in saturated region to attain an transistor operation. Thus, the reference voltage Vo generated by the present generator 200 is stabilized against the variation in power supply voltage due to the noise component.

If, desired, one or more voltage-drop element such as a diode-connected transistors may be connected between the transistor 9 and the inverting input terminal 6 and between the transistor 12 and the non-inverting input terminal 7.

Figure 3:
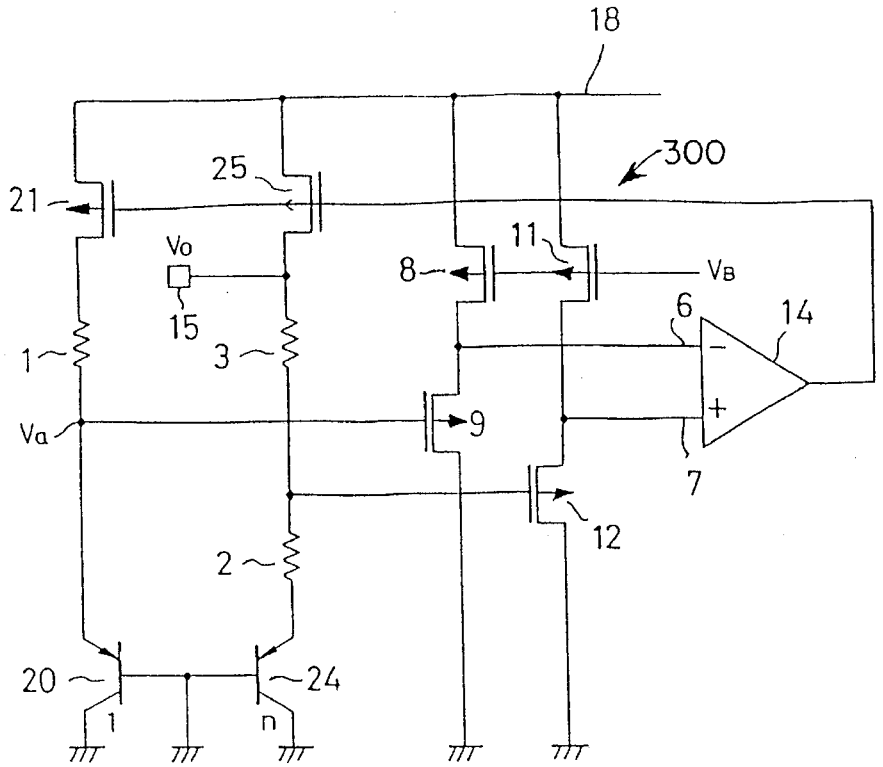
FIG. 3 is a circuit diagram illustrative of a reference voltage generator according to another embodiment of the present invention.

Referring to FIG. 3, a reference voltage generator 300 according to another embodiment of the present invention includes P-channel MOS transistors 21 and 25 having gates connected in common to the output terminal of the operational amplifier 14 in place of the bipolar transistors 4 and 5 shown in FIG. 2. There are further provide two PNP bipolar transistors 20 and 24. The bases and collectors of the transistors 20 and 24 are connected to the ground line. The emitter of the transistor 20 is connected through the resistor 1 to the drain of transistor 21 and further to the gate of transistor 9. The emitter of the transistor 24 is connected through resistors 2 and 3 to the drain of the transistor 25, and the node of the resistors 2 and 3 is connected to the gate of the transistor 12. In this generator, moreover, the output terminal 15 is derived from the drain of the transistor 25, not from the output of the amplifier 14.

In the circuit thus constructed, the difference DVBE between the base-emitter voltages VBE20 and VBE24 of the transistors 20 and 24 appears across the resistor 2 and represented as follows:

$$\begin{aligned} DVBE &= VBE20 - VBE24 \\ &= (kT/q)\ln(n \cdot R3/R1) \end{aligned} \tag{6}$$

Accordingly, the current I24 flowing through the transistor 24 is denoted as follows:

$$\begin{aligned} I24 &= DVBE/R2 \\ &= (1/R2) \cdot (kT/q)\ln(n \cdot R3/R1) \end{aligned} \tag{7}$$

Thus, the reference voltage Vo is represented as follows:

$$\begin{aligned} Vo &= VBE20 + I24R3 \\ &= VBE20 + (R3/R2) \cdot (kT/q)\ln(n \cdot R3/R1) \end{aligned} \tag{8}$$

The generator 300 also generates a reference voltage Vo. Further, the operational amplifier 14 received the level-shifted voltage to thereby made the MOS transistors 40 and 41 (FIG. 4) operative in a saturated region.

It is apparent that the present invention is not limited to the above embodiments, but may be modified and changed without departing from the scope and spirit of the invention. For example, the channel types of all the MOS transistors and conductivity types of all the bipolar transistors are changed to the other type, respectively.

What is claimed is:

1. A reference voltage generator comprising first and second bipolar transistors; a resistor circuit coupled to said first and second bipolar transistors to make said first and second bipolar transistors operative in different current densities from each other to thereby produce a predetermined voltage relative to a difference in base-emitter voltages between said first and second bipolar transistors; a level shift circuit receiving and shifting said predetermined voltage to produce a level-shifter voltage; an operational amplifier composed of field effect transistors and receiving said level-shifted voltage to control a current flowing through said resistor circuit in response thereto; and first and second field effect transistors each having a gate supplied with an output voltage of said operational amplifier, said resistor circuit including a first resistor connected between said first field affect transistor and said first bipolar transistor and second and third resistors connected in series between said second field effect transistor and said second bipolar transistor, wherein each of said first and second bipolar transistors has a base and a collector connected to a reference potential line.

2. The generator as claimed in claim 1, wherein a reference voltage is derived from a connection point of said second field effect transistor and said third resistor.

3. The generator as claimed in claim 2, wherein said operational amplifier has first and second input terminals and said level shifter includes a third field effect transistor connected between said first input terminal and said reference potential line and having a gate connected to an emitter of said first bipolar transistor and a fourth field effect transistor connected between said second input terminal and said reference potential line and having a gate connected to a connection point of said second and third resistors.

4. A reference voltage generator comprising first and second power lines, a first bipolar transistor having collector connected to said first power line, an emitter and a base, a second bipolar transistor having a collector connected to said first power line, an emitter and a base, a first resistor connected between the emitter of said first bipolar transistor and said second power line, second and third resistors connected in series between the emitter of said second bipolar transistor and said second power line, an operational amplifier having a first input terminal, a second input terminal and an output terminal, means for connecting the output terminal of said operational amplifier to the bases of said first and second bipolar transistors, a first field effect transistor connected between the first input terminal of said operational amplifier and said second power line and having a gate connected to the emitter of said first bipolar transistor, and a second field effect transistor connected between the second input terminal of said operational amplifier and said second power line add having a gate connected to a connection point of said second and third resistors, wherein said connecting means includes fourth and fifth resistors connected in series between the output terminal of said operational amplifier and said second power line, the gates of said first and second bipolar transistors being connected to a connection point of said fourth and fifth resistors.

5. A reference voltage generator comprising first and second power lines, a first field effect transistor connected between said first power line and a first node, a second field effect transistor connected between said first power line and a second node, a first bipolar transistor having a base and a collector connected to said second power line and an emitter, a second bipolar transistor having a base and a collector connected to said second power line and an emitter, a first resistor connected between said first node and the emitter of said first bipolar transistor, second and third resistors connected in series between said second node and the emitter of said second bipolar transistor, an operational amplifier having a first input terminal, a second input terminal and an output terminal, means for connecting the output terminal of said operational amplifier to gates of said first and second field effect transistors, a third field effect transistor connected between the first input terminal of said operational amplifier and said second power line and having a gate connected to the emitter of said first bipolar transistor, and a fourth field effect transistor connected between the second input terminal of said operational amplifier and said second power line and having a gate connected to a connection point of said second and third resistors.

6. The generator as claimed in claim 5, further comprising a first current source connected between the first input terminal of said operational amplifier and said first power line and a second current source connected between the second input terminal of said operational amplifier and said first power line.

* * * * *